US005546722A

United States Patent [19]

Huang

[11] Patent Number: 5,546,722

[45] Date of Patent: Aug. 20, 1996

[54] MODULAR ROOF STRUCTURE

[76] Inventor: Yen T. Huang, 9405 Pinewood Dr., Dallas, Tex. 75243

[21] Appl. No.: 997,339

[22] Filed: Dec. 28, 1992

Related U.S. Application Data

[63] Continuation-in-part of Ser. No. 681,179, Apr. 5, 1991.

[51] Int. Cl.[6] ..... E04H 12/18

[52] U.S. Cl. ..... 52/646; 52/2.17; 52/638

[58] Field of Search ..... 52/63, 638, 640, 52/646, 645, 217, 2.18, 2.22; 135/105, 107.18, 111; 52/638, 640, 646, 645, 649.5; 472/118; 298/370

[56] References Cited

U.S. PATENT DOCUMENTS

| | | | |
|---|---|---|---|
| D. 260,934 | 9/1981 | Levin . | |
| 952,879 | 3/1910 | Crocker | 135/108 |
| 1,786,928 | 12/1930 | Wrigley . | |
| 2,296,358 | 9/1942 | Marinsky et al. | 135/97 |
| 2,541,784 | 2/1951 | Shannon . | |
| 2,564,398 | 8/1951 | Eicholtz | 472/118 |
| 2,771,896 | 11/1956 | Call | 135/107 |
| 2,855,617 | 10/1958 | Broms et al. | 52/646 |
| 3,271,029 | 9/1966 | Grudoski | 248/370 |
| 3,534,515 | 10/1970 | Beed . | |
| 3,945,156 | 3/1976 | Hamm | 52/2.17 |
| 3,957,069 | 5/1976 | Denaro . | |
| 4,000,585 | 1/1977 | Denaro | 52/2.17 |
| 4,288,947 | 9/1981 | Huang . | |
| 4,632,566 | 1/1987 | Coppa | 52 X/646 |
| 4,783,936 | 11/1988 | Hujsak | 52 X/646 |
| 4,813,191 | 3/1989 | Huang . | |
| 4,898,198 | 2/1990 | Castlebury | 472 X/118 |
| 4,903,452 | 2/1990 | Huang . | |
| 4,959,901 | 10/1990 | Parish | 52/2.18 |
| 4,974,621 | 12/1990 | Lerma | 135 X/107 |

FOREIGN PATENT DOCUMENTS

| | | | |
|---|---|---|---|
| 438681 | 12/1967 | Switzerland | 52/2.18 |
| 2063959 | 6/1981 | United Kingdom | 52/645 |

OTHER PUBLICATIONS

NASA/MSFC Contract NA58–38677, Development of Deployable Structures for Large Space Platforms Systems, Interim Report, Aug. 1982.

*Primary Examiner*—Carl D. Friedman
*Assistant Examiner*—Beth A. Aubrey

[57] ABSTRACT

A roof structure is formed with first and second Y-shaped modular construction members. The first construction member is comprised of first, second and third branches of substantially equal length. The second construction member is comprised of fourth, fifth and sixth branches of substantially equal length. The first and fourth branches are coupled together along a common axis to define an apex or ridge of the roof structure. The second, third, fifth and sixth branches are coupled between the apex and respective first, second, third and fourth corners of a rectangular base frame. At least one gable is positioned intermediate the first and second construction members. In one embodiment, an intermediate section of the roof structure is lengthwise adjustable to adjust the length of the roof structure along the aforementioned common axis. The roof structure of the present invention is adapted to accommodate a foldable or inflatable roof cover.

15 Claims, 7 Drawing Sheets

MODULAR ROOF STRUCTURE

This is a continuation-in-part of co-pending application Ser. No. 07/681,179, filed Apr. 5, 1991.

FIELD OF INVENTION

This invention relates generally to roof structures and in particular to a roof structure formed with modular Y-shaped components.

BACKGROUND OF THE INVENTION

Roof structures are typically formed by installing roof trusses or joists at spaced intervals along the structural walls of a building. Conventional roof structures require multiple components to be assembled in order to form the roof structure.

DISCLOSURE OF THE INVENTION

In accordance with the present invention, a building roof structure is comprised of a base frame having first, second, third and fourth corners, a first structural member having first, second and third branches interconnected to define a Y-shape with respective predetermined space angles between adjacent ones of the first, second and third branches; and a second structural member having fourth, fifth and sixth branches interconnected to define a Y-shape with respective predetermined space angles between adjacent ones of the fourth, fifth and sixth branches. The first and fourth branches are coupled along a common axis to define an apex of the roof structure. The second, third, fifth and sixth branches are coupled between the apex and the respective first, second, third and fourth corners of the base frame.

In accordance with a unique feature of the invention, an intermediate section of the roof structure is lengthwise adjustable along an axis parallel to the aforementioned common axis. In one embodiment, the intermediate section includes first and second members defining an intermediate portion of the apex, the first member being adjustable with respect to the second member along the common axis. The intermediate portion further includes third, fourth, fifth and sixth members. The third member is adjustable with respect to the fourth member along a first axis parallel to the common axis, to define an intermediate portion of a first side of the base frame. The fifth member is adjustable with respect to the sixth member along a second axis parallel to the common axis, to define an intermediate portion of a second side of the base frame, opposite from the first side thereof. The intermediate section is therefore lengthwise adjustable.

DETAILED DESCRIPTION OF THE PREFERRED EMBODIMENT

Figure 2B:
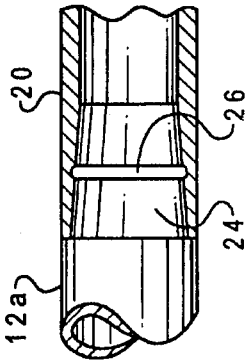
FIG. 2B is a detailed view of a slip in lock type connector as an alternate to the turnbuckle screw type connector of FIG. 2A.

In the description which follows, like parts are marked throughout the specification and drawings with the same respective reference numerals. The drawings are not necessarily to scale and in some instances proportions may have been exaggerated in order to more clearly depict certain features of the invention.

Figure 2A:
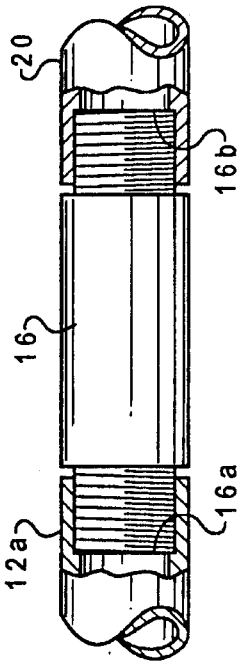
FIG. 2A is a detailed view of a turnbuckle screw type connector used in the roof structure of FIG. 1.
Figure 1:
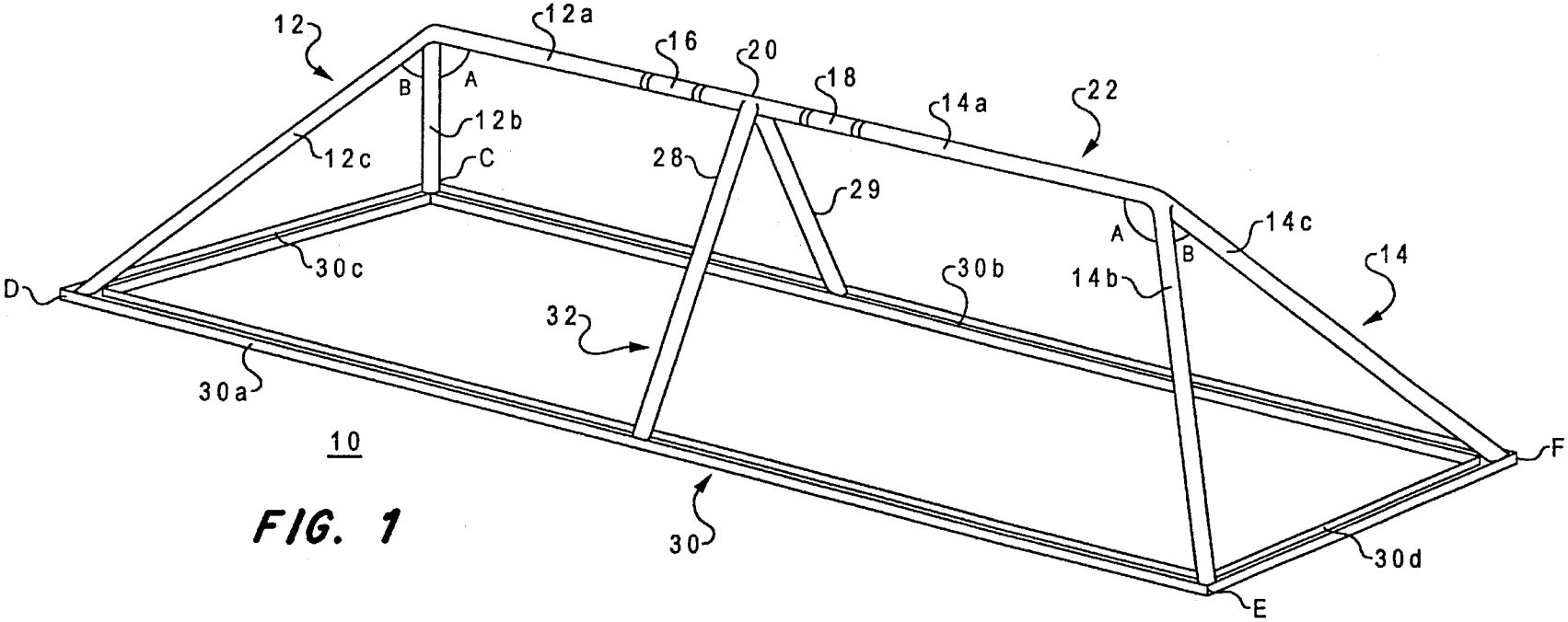
FIG. 1 is a perspective view of a modular roof structure, according to the present invention.
Figure 3:
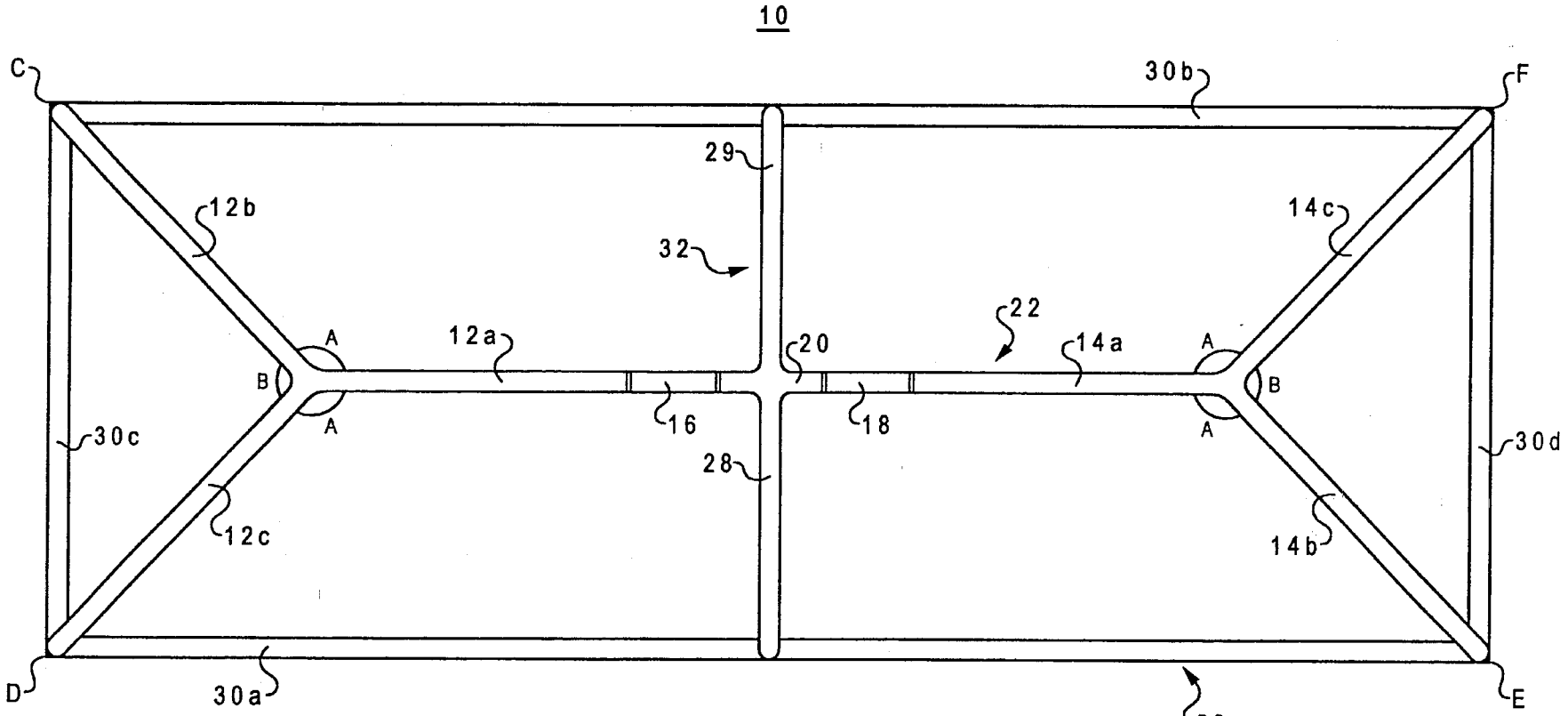
FIG. 3 is a top plan view of the roof structure of FIG. 1.

Referring to FIGS. 1–3, a modular roof structure 10 includes first and second generally Y-shaped construction members 12 and 14. Member 12 is comprised of first, second and third branches 12*a*, 12*b* and 12*c* of substantially equal length, which are interconnected to define a rigid Y-shape, with respective space angles between adjacent ones of branches 12*a*, 12*b* and 12*c*. Space angle A is between first branch 12*a* and second branch 12*b* and between first branch 12*a* and third branch 12*c*. Space angle B is between second and third branches 12*b* and 12*c*. Each branch 12*a*, 12*b*, 12*c* is a hollow tubular member adapted to receive another tubular member (not shown) in mating relationship. Member 14 is comprised of first, second and third branches 14*a*, 14*b* and 14*c* of substantially equal length and is configured the same as member 12.

The corresponding first branches 12*a* and 14*a* of construction members 12 and 14 are threaded on respective interior surfaces thereof adjacent respective distal ends thereof for receiving respective threaded male ends of respective turnbuckle devices 16 and 18. Threaded male end 16*a* of turnbuckle 16 is shown in mating engagement with branch 12*a* in FIG. 2A. The respective opposed threaded male ends of turnbuckles 16 and 18 are adapted for mating engagement with internal threaded surfaces adjacent respective opposed ends of a tubular sleeve 20. Threaded male end 16*b* of turnbuckle 16 is shown in mating engagement with sleeve 20 in FIG. 2A. Branch 12*a* is maintained in horizontal alignment with branch 14*a* by sleeve 20 and turnbuckles 16 and 18, to define an apex (ridge) 22 of roof structure 10.

Alternatively, in lieu of turnbuckles 16 and 18, the respective distal ends of branches 12*a* and 14*a* each have respective a tapered male fitting with an annular ring in concentric relationship therewith. The tapered male fitting of each branch 12*a*, 14*a* is adapted for mating engagement with sleeve 20. Sleeve 20 has an annular groove adjacent each end thereof for receiving the annular ring of the corresponding branch 12*a*, 14*a*. Tapered male fitting 24 of branch 12*a* is shown in mating engagement with sleeve 20 in FIG. 2B, with annular ring 26 received in the corresponding annular groove of sleeve 20.

Tubular members 28 and 29 extend outwardly and downwardly from sleeve 20, defining the pitch of roof structure 10 on the sides thereof. A rectangular frame 30 defines the base of roof structure 10. The sides of frame 30 are defined by respective edge beams 30*a* and 30*b*, which extend along the major axis of frame 30. The ends of frame 30 are defined by respective edge beams 30*c* and 30*d*, which extend along the minor axis of frame 30.

Tubular sleeves 28 and 29 are anchored on respective edge beams 30*a* and 30*b* to define a V-shaped gable 32 at the approximate geometric center of roof structure 10. Second and third branches 12*b* and 12*c* of construction member 12 are anchored at respective first and second corners C and D of base frame 30. Second and third branches 14*b* and 14*c* of construction member 14 are anchored at respective third and fourth corners E and F of base frame 30. Branches 12*b* and 12*c* are inclined upwardly and inwardly from edge beam 30*c* to define a hip type structure at one end of roof structure 10. Branches 14*b* and 14*c* are inclined upwardly and inwardly from edge beam 30*d* to define a hip type structure at an opposite end of roof structure 10. Branches 12*c* and 14*b* cooperate with apex 22 and edge beam 30*a* to define an inclined, trapezoidal first side of roof structure 10. Branches 12*b* and 14*c* cooperate with apex 22 and edge beam 30*b* to define an inclined, trapezoidal second side of roof structure 10.

Figure 4:
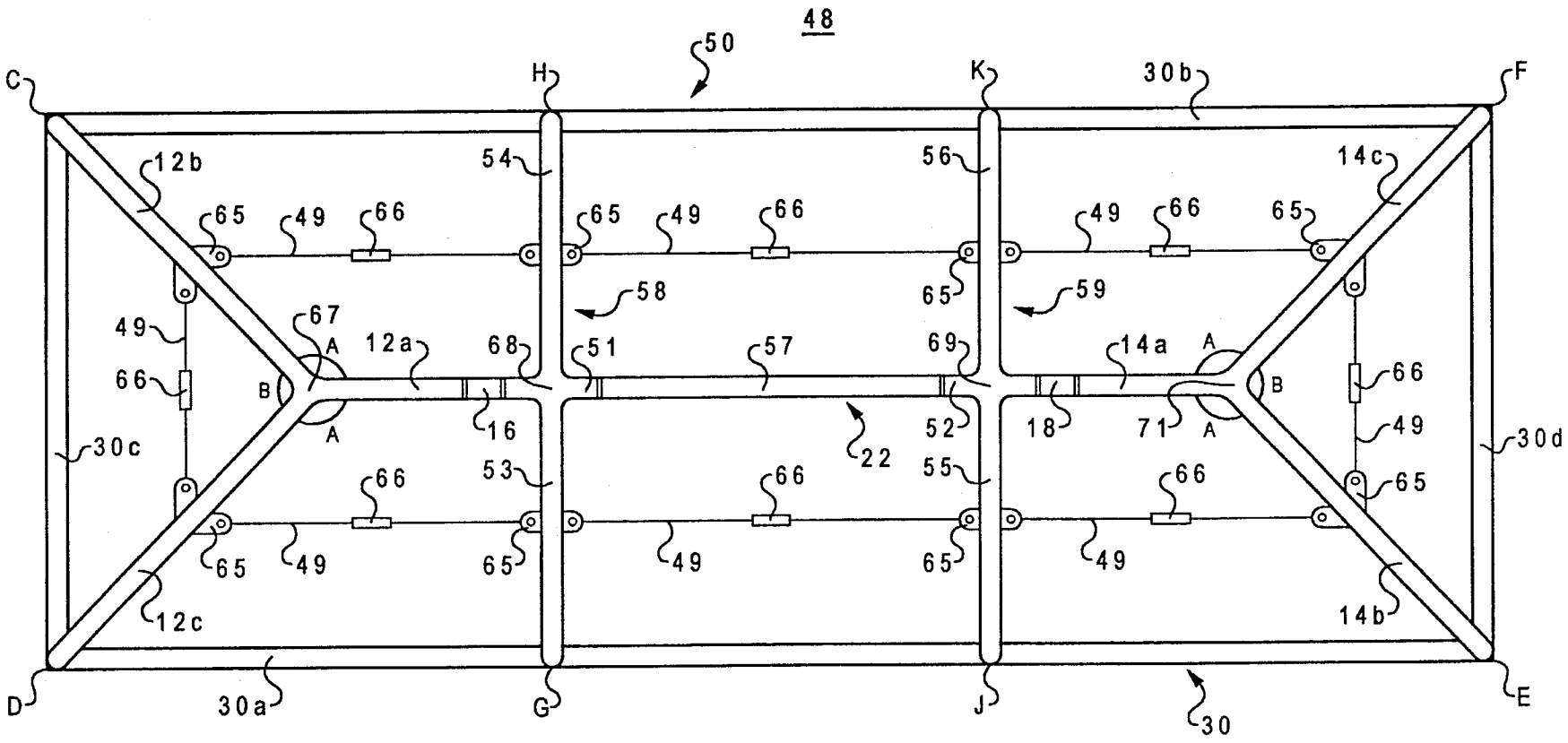
FIG. 4 is a top plan view of a first alternate embodiment of a modular roof structure, according to the present invention.

Referring now to FIG. 4, a modular roof structure 48, according to the present invention, includes reinforcing members 49 to enhance the structural integrity of roof structure 48. Reinforcing members 49 are preferably guy wires. In accordance with a unique feature of the invention, the length of roof structure 48 along an axis parallel to the common axis along which branches 12*a* and 14*a* are aligned is adjustable by adjusting the lengthwise extent of an intermediate section 50 of structure 48 along the aforementioned common axis. Intermediate section 50 is defined by tubular sleeves 51 and 52 and by tubular members 53, 54, 55, 56 and 57. Tubular member 57 extends between sleeves 51 and 52. Tubular members 53 and 54 extend downwardly and outwardly at an angle from sleeve 51 and tubular members 55 and 56 extend downwardly and outwardly at an angle from sleeve 52 to define the pitch of roof structure 48 on the sides thereof. Tubular members 53 and 54 are anchored on respective edge beams 30*a* and 30*b* at respective points G and H to define a first V-shaped gable 58 and tubular members 55 and 56 are anchored on respective edge beams 30*a* and 30*b* at respective points J and K to define a second V-shaped gable 59.

Guy wires 49 extend between branches 12*b*, 12*c*, 14*b*, 14*c* and tubular members 53, 54, 55 and 56, intermediate apex 22 and base frame 30. Guy wires 49 are coupled to the respective tubular connectors by means of ears 65. Connector sleeves 66 are used to interconnect adjacent guy wires 49. Although tensile reinforcements are shown in FIG. 4, reinforcing members may be used in lieu of guy wires where reversal of stresses occurs.

Roof structure 48 is lengthwise adjustable by adjusting the spacing between first and second gables 58 and 59, to adjust the lengthwise extent of intermediate section 50. By adjusting the lengthwise extent of intermediate section 50, the portions of roof structure 48 on respective opposite sides of intermediate section 50 can be drawn together or moved apart, to selectively contract or expand roof structure 48, as desired. The respective lengths of edge beams 30*a* and 30*b* and tubular member 57 are selected to correspond to the lengthwise extent of roof structure 48.

The dimensional relationships among the various structural members are determined as follows. Assuming the length of the portion of apex 22 between positions 67 and 68 and between positions 69 and 71 are each L, and the respective space angles are A and B, as indicated, the structural dimensions are as follows:

C to D and E to F=2L sin B/2

C to H and D to G=2L $\sin^2$ A/2

J to E and K to F=2L $\sin^2$ A/2

If the length of the intermediate portion of apex 22 between positions 68 and 69 is assumed to be M, the following dimensional relationships apply:

G to J and H to K=M.

C to F and D to E=4L $\sin^2$A/2+M.

One skilled in the art will recognize that both the size and configuration of roof structure 48 is a function of the length of apex 22 (2L+M) and the respective space angles between adjacent ones of branches 12*a*, 12*b* and 12*c* and between adjacent ones of branches 14*a*, 14*b* and 14*c*. Roof structure 48 is lengthwise adjustable by adjusting the longitudinal extent of intermediate section 50, as previously described.

Figure 5:
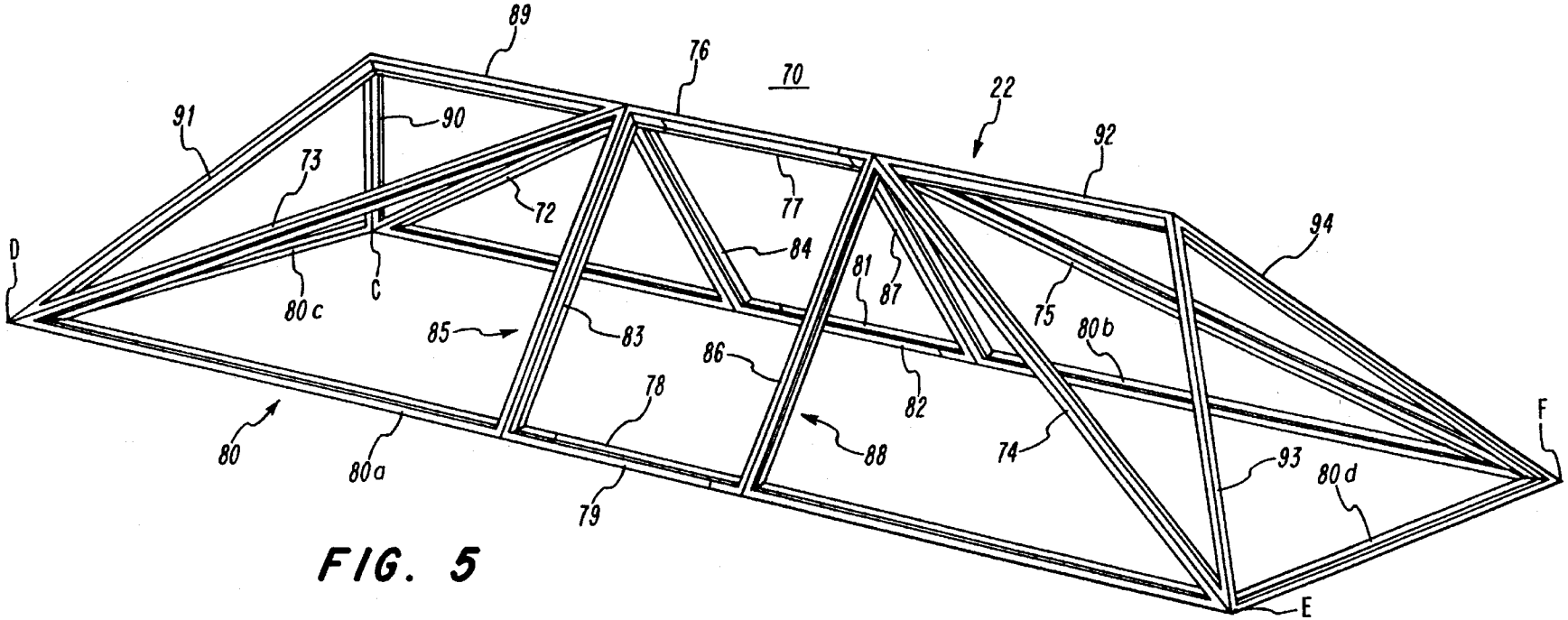
FIG. 5 is a perspective view of a second alternate embodiment of a modular roof structure, according to the present invention.

Referring now to FIG. 5, a modular roof structure 70 is depicted. Roof structure 70 has substantially the same configuration as roof structure 48, described above with reference to FIG. 4, except that the structural components are channel beams, instead of tubular members. Each channel beam has opposed side flanges defining a channel between the corresponding side flanges. Four channel beams 72, 73, 74 and 75 extend diagonally between apex 22 and respective corners C, D, E and F of a rectangular base frame 80 of roof structure 70, function as bracing members to enhance the structural integrity of roof structure 70. The bracing members are used in roof structure 70 in lieu of guy wires 49 (FIG. 4). The intermediate portion of apex 22 is defined by a telescoped pair of beams 76 and 77. The intermediate portion of first side 80*a* of base frame 80 is defined by a telescoped pair of beams 78 and 79. The intermediate portion of second side 80*b* of base frame 80 is defined by a telescoped pair of beams 81 and 82. Beams 83 and 84 extend downwardly and outwardly from apex 22 to define a first V-shaped gable 85. Beams 86 and 87 extend downwardly and outwardly from apex 22 to define a second V-shaped gable 88. By adjusting the respective positions of the telescoped beam pairs, the spacing between gables 85 and 88 is adjustable to adjust the lengthwise extent of roof structure 70.

Beams 89, 90 and 91 are joined to define a generally Y-shaped first construction member and beams 92, 93 and 94 are joined to define a generally Y-shaped second construction member. Beams 89 and 92 are aligned along apex 22. Beams 90 and 91 are inclined upwardly and inwardly from a first end 80*c* of base frame 80 to define a first hip type roof end. Beams 90 and 91 are anchored at respective corners C and D of base frame 80. Beams 93 and 94 are inclined upwardly and inwardly from a second end 80*d* of base frame 80 to define a second hip type roof end. Beams 93 and 94 are anchored at respective corners E and F.

Figure 6:
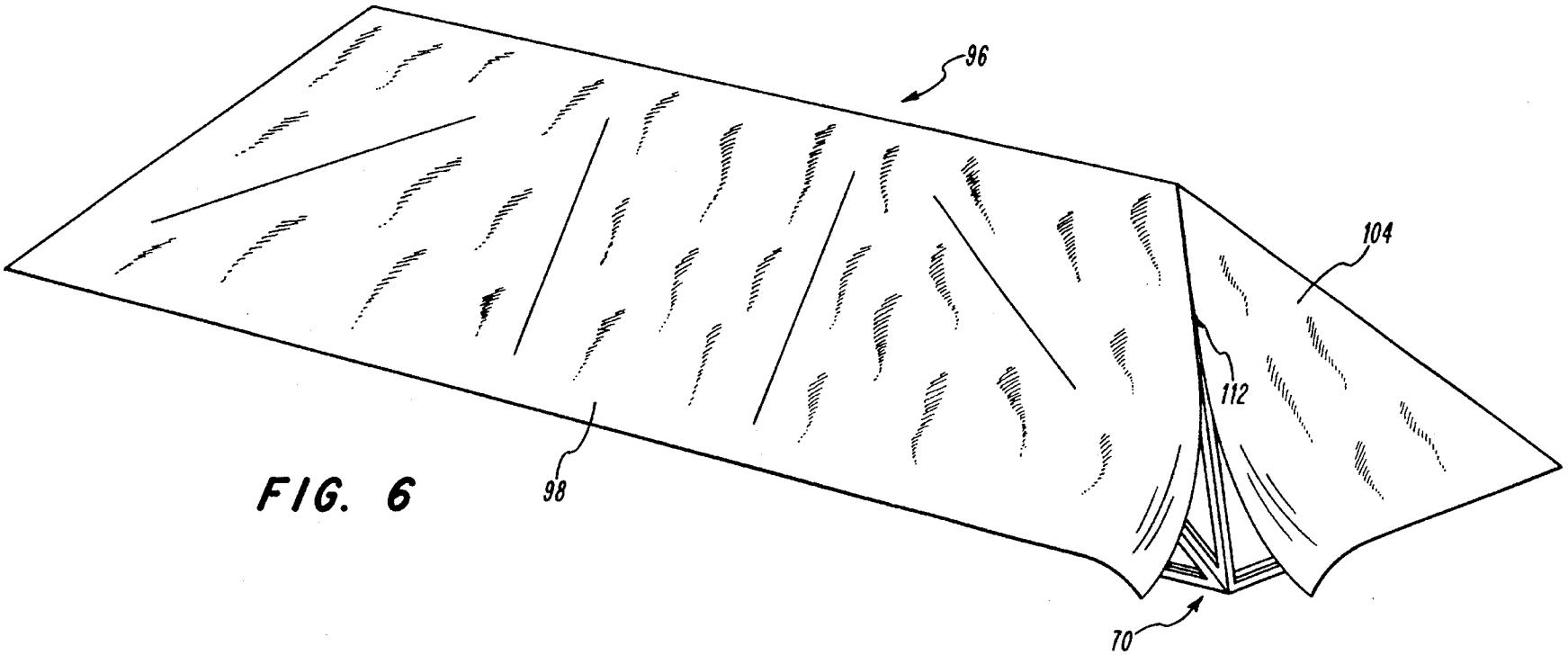
FIG. 6 is a perspective view of the modular roof structure of FIG. 5, with a flexible cover enveloping the roof structure.
Figure 7:
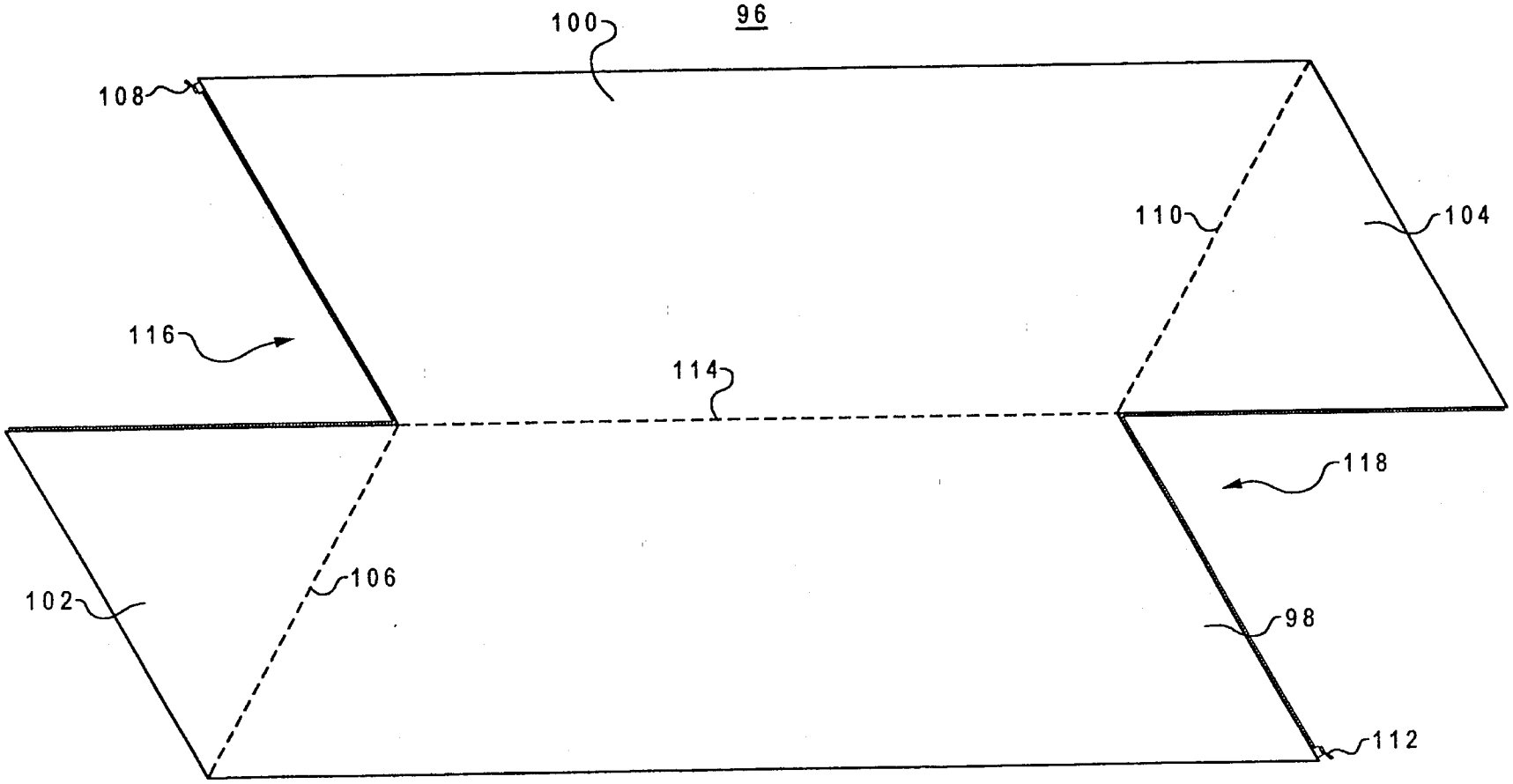
FIG. 7 is a top plan view of the flexible cover of FIG. 6, spread out on a flat surface.

Referring now to FIGS. 6 and 7, a roof cover 96 is provided for substantially enveloping roof structure 70, as can be best seen in FIG. 6. Cover 96 is preferably comprised of a flexible fabric or canvas material. The size and shape of cover 96 is dependent upon the configuration of the corresponding roof structure 70. Cover 96 is comprised of first and second side panels 98 and 100, respectively, which are adapted to cover respective first and second trapezoidal sides of roof structure 70. Cover 96 further includes first and second end panels 102 and 104, respectively, which are adapted to cover respective first and second triangular ends of roof structure 70. First end panel 102 is formed with first side panel 98 along line 106 and is detachably secured to second side panel 100 by an appropriate attachment device such as a zipper 108. Second end panel 104 is formed with second side panel 100 along line 110 and is detachably secured to first side panel 98 by an appropriate attachment device such as a zipper 112. First side panel 98 is formed with second side panel 100 along line 114.

First and second end panels 102 and 104 are formed by cutting a predetermined pattern to remove respective wedge-shaped sections 116 and 118. First and second end panels 102 and 104 are folded over the respective first and second triangular ends of roof structure 70 and are detachably secured to the respective second and first side panels 100 and 98 by means of the respective first and second zipper members 108 and 112.

Figure 8B:
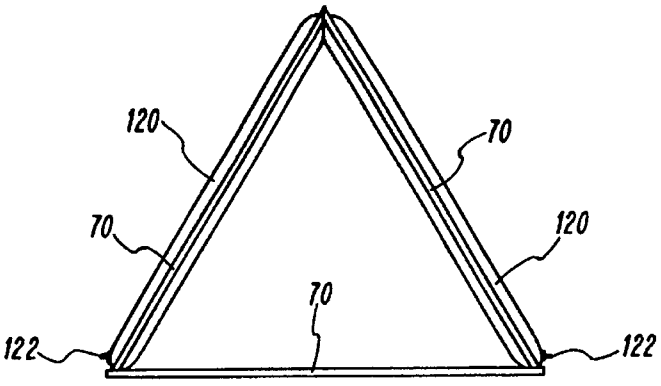
FIG. 8B is a sectional view, taken along line 8B—8B of FIG. 8A.
Figure 8A:
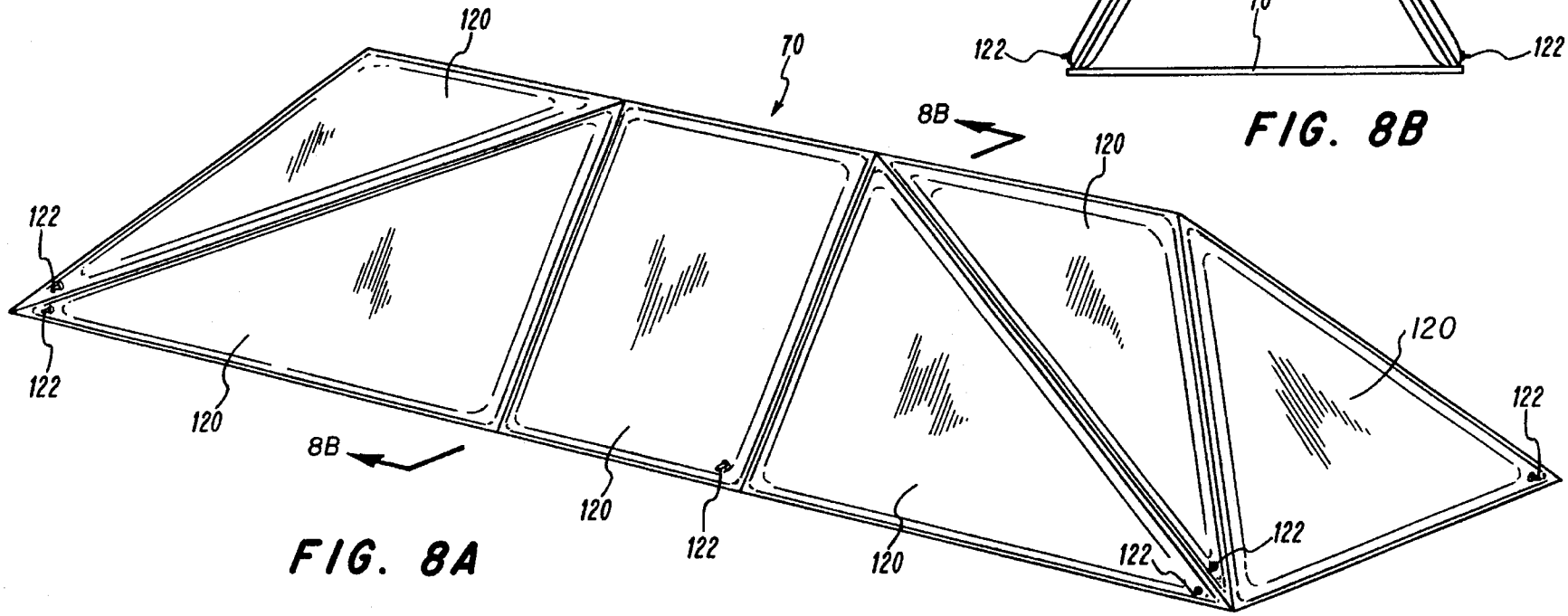
FIG. 8A is a perspective view of a roof structure with an inflatable cover, according to the present invention.

Referring to FIGS. 8A and 8B, an inflatable cover 120 is provided for substantially enveloping roof structure 70. Inflatable cover 120 is comprised of a plurality of sections, which are separately inflatable by means of dedicated inflation valves 122. Each valve 122 is adapted for connection to a gas source for inflating the corresponding cover section.

In accordance with the present invention, a modular roof structure is provided, which is suitable for low cost, efficient construction. The roof structure can be configured to accommodate various types of roofing materials, including napar, shingle, metal, plastic or inflatable material. Selection of the particular material depends upon the environment and the forces which the structure is designed to withstand, as well as aesthetic considerations. The modular components, including the rigid Y-shaped members are preferably manufactured in a factory where close quality controls and precise measurements are readily available. The individual components of the roof structure may be connected by any conventional means, including welding, connector bolts and plates, or connecting sleeves. By eliminating the need for conventional roof trusses, substantial savings in material costs are achievable. Labor costs at the construction site are also decreased due to the modularity of the components and the simplicity of the structural connections.

The preferred embodiment of the invention has now been described in detail. Since it is obvious that many changes in and additions to the above-described preferred embodiment may be made without departing from the nature, spirit and scope of the invention, the invention is not to be limited to the disclosed details, except as set forth in the appended claims.

What is claimed is:

1. A building roof structure, comprising:

a base frame having first, second, third and fourth corners;

a first construction member having first, second and third branches interconnected to define a Y-shape with respective space angles between adjacent ones of said first, second and third branches;

a second construction member having fourth, fifth and sixth branches interconnected to define a Y-shape with respective space angles between adjacent ones of said fourth, fifth and sixth branches, said first and fourth branches being coupled along a common axis to define an apex of said roof structure, said second, third, fifth and sixth branches being coupled between said apex and the respective first, second, third and fourth corners of said base frame;

a section intermediate said first and second construction members;

wherein said intermediate section includes first, second, third and fourth members, said first and second members extending between said apex and respective opposed first and second sides of said base frame to define a first gable, said third and fourth members extending between said apex and the respective opposed first and second sides of said base frame to define a second gable; and means for adjusting the distance between said first and second gables along said common axis, whereby said intermediate section is lengthwise adjustable.

2. A building roof structure comprising:

a base frame having first, second, third and fourth corners and first and second spaced apart sides;

a first roof construction member having a first branch forming at least a part of an apex of said roof structure vertically spaced from said base frame and second and third branches integrally joined to said first branch to form a rigid "Y" shaped member, said second and third branches extending from said first branch to and engaged with respective ones of said first and second corners of said base frame and without a joint connection formed along any part of a longitudinal span of said second and third branches of said first construction member between said first branch and said first and second corners, respectively;

a second construction member having a fourth branch forming at least another part of said apex of said roof structure and fifth and sixth branches integrally joined to said fourth branch to form a rigid "Y" shaped member, said fifth and sixth branches extending from said fourth branch to and engaged with respective ones of said third and fourth corners of said base frame and without a joint connection formed along any part of a longitudinal span of said fifth and sixth branches of said second construction member between said fourth branch and said third and fourth corners, respectively; and means interconnecting said first and fourth branches of said construction members whereby said first and fourth branches lie along a common axis to define said apex of said roof structure.

3. The roof structure of claim 2 wherein each one of said first, second, third, fourth, fifth and sixth branches is tubular.

4. The roof structure of claim 3 wherein said base frame is comprised of first, second, third and fourth edge beams interconnected to define a rectangular shape.

5. The roof structure of claim 2 further including reinforcing means for reinforcing the structural integrity of said roof structure comprising first, second, third and fourth reinforcing members extending between said apex and the respective first, second, third and fourth corners of said base frame.

6. The roof structure of claim 2 further including a section intermediate said first and second construction members comprising first, second, third and fourth intermediate members, said first and second intermediate members extending between said apex and respective one of said first and second sides of said base frame to define a first gable, said third and fourth intermediate members extending between said apex and said respective opposed first and second sides of said base frame to define a second gable.

7. The roof structure of claim 2 further including a foldable cover adapted to envelope said roof structure.

8. The roof structure of claim 7 wherein said cover is comprised of first and second side panels adapted to cover respective first and second sides of said roof structure and first and second end panels adapted to cover respective first and second ends of said roof structure, said first end panel being formed with said first side panel and being detachably secured to said second side panel, said second end panel being formed with said second side panel and being detachably secured to said first side panel.

9. The roof structure of claim 8 further including first securing means for detachably securing said first end panel to said second side panel and second securing means for detachably securing said second end panel to said first side panel.

10. The roof structure of claim 9 wherein said first securing means is comprised of first zipper means and said second securing means is comprised of second zipper means.

11. The roof structure of claim 2 further including an inflatable cover adapted to envelope said roof structure, said cover having at least one valve which is connectable to a gas source for inflating said cover.

12. A building roof structure comprising:

a base frame having first, second, third and fourth corners and first and second spaced apart sides;

a first roof construction member having a first branch forming at least a part of an apex of said roof structure vertically spaced from said base frame and second and third branches integrally joined to said first branch to form a rigid "Y" shaped member, said second and third branches extending from said first branch to and engaged with respective ones of said first and second corners of said base frame and without a joint connection formed along any part of a longitudinal span of said second and third branches of said first construction member between said first branch and said first and second corners, respectively;

a second construction member having a fourth branch forming at least another part of said apex of said roof structure and fifth and sixth branches integrally joined to said fourth branch to form a rigid "Y" shaped member, said fifth and sixth branches extending from said fourth branch to and engaged with respective ones of said third and fourth corners of said base frame and without a joint connection formed along any part of a longitudinal span of said fifth and sixth branches of said second construction member between said fourth branch and said third and fourth corners, respectively; and an intermediate section of said roof structure disposed between and connected to said first and second construction members, respectively, the length of said intermediate section being selected so as to provide for a predetermined length of said roof structure along said common axis.

13. The roof structure of claim 12 wherein said intermediate section includes first and second members defining an intermediate portion of said apex, said first member being adjustable with respect to said second member along said common axis, said intermediate section further including third, fourth, fifth and sixth members, said third member being adjustable with respect to said fourth member along a first axis parallel to said common axis, to define an intermediate portion of a first side of said base frame, said fifth member being adjustable with respect to said sixth member along a second axis parallel to said common axis, to define an intermediate portion of a second side of said base frame, opposite from said first side, whereby said intermediate section is lengthwise adjustable.

14. The roof structure of claim 13 wherein each of said first, second, third, fourth, fifth and sixth members is a beam with opposed side flanges defining a channel between the corresponding opposed side flanges, said first member being telescoped within the channel of said second member, said third member being telescoped within the channel of said fourth member, said fifth member being telescoped within the channel of said sixth member.

15. A hip roof structure for a building, comprising:

a generally rectangular base frame having first, second, third and fourth corners and first and second spaced apart, generally parallel sides;

a first roof construction member having a first branch forming at least part of an apex of said roof structure vertically spaced from said base frame and second and third branches integrally joined to said first branch to form a rigid "Y" shaped member, said second and third branches extending from said first branch to and engaged with respective ones of said first and second corners of said base frame and without a joint connection formed along any part of a longitudinal span of said second and third branches of said first construction member between said first branch and said first and second corners, respectively;

a second construction member having a fourth branch forming at least another part of said apex of said roof structure and fifth and sixth branches integrally joined to said fourth branch to form a rigid "Y" shaped member, said fifth and sixth branches extending from said first branch to and engaged with respective ones of said third and fourth corners of said base frame member without a joint connection formed along any part of a longitudinal span of said fifth and sixth branches of said second construction member between said fourth branch and said third and fourth corners, respectively;

at least one intermediate section of said roof structure comprising a portion forming another part of said apex and opposed members depending from said portion downwardly and outwardly and connected to respective ones of said parallel sides of said base frame; and intermediate members comprising tensionable guywires interconnecting said second and third branches of said first construction member and said fifth and sixth branches of said second construction member and said opposed members of said intermediate section with said second and third branches and said fifth and sixth branches, respectively, to provide reinforcement of said roof structure.

* * * * *